US006660440B2

(12) United States Patent
Jentzsch

(10) Patent No.: US 6,660,440 B2
(45) Date of Patent: Dec. 9, 2003

(54) METHOD FOR FORMING A PRINTING PLATE IN PRINTING MACHINES

(75) Inventor: Arndt Jentzsch, Coswig (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 09/947,970

(22) Filed: Sep. 6, 2001

(65) Prior Publication Data

US 2002/0106569 A1 Aug. 8, 2002

(51) Int. Cl.[7] ..... G03G 19/00

(52) U.S. Cl. ..... 430/39; 430/39; 430/49; 430/125

(58) Field of Search ..... 430/39, 49, 125; 101/463.1, 465, 466, 467

(56) References Cited

U.S. PATENT DOCUMENTS 3,011,436 A * 12/1961 Berry ..... 101/463.1
5,305,019 A * 4/1994 Orth et al. ..... 430/49
5,848,332 A * 12/1998 Machida ..... 430/49

* cited by examiner

*Primary Examiner*—Janis L. Dote
(74) *Attorney, Agent, or Firm*—Goodwin Procter LLP

(57) ABSTRACT

The present invention relates to a process for generating a printing image carrying printing form on a printing form cylinder in a printing press. The printing image carrying printing form is an erasable printing form on a printing form cylinder of a printing press with low expenditure and high life expectancy. The printing form cylinder has a magnetizeable surface, which can carry a magnetized image and be coated with a toner. The toner adheres to the printing form cylinder. Printing is completed with the printing form created in this manner. After printing, a laser is used to erase the toner from the printing form cylinder.

2 Claims, 1 Drawing Sheet

METHOD FOR FORMING A PRINTING PLATE IN PRINTING MACHINES

FIELD OF THE INVENTION

The present invention relates to a process for generating a printing image carrying a printing form on a printing form cylinder in a printing press.

BACKGROUND OF THE INVENTION

A process for generating a printing form in the printing press of offset presses, especially offset presses with dampening units, with hydrophobic image areas taking the printing ink and hydrophilic areas influencing the affinity to water is disclosed in DE 4119111 A1. In this process, at least one nozzle connected to a reservoir generates small droplets of oleophilic and water resistant coating material in the form of dots or matrices adequate to the image on a hydrophilic printing form cylinder surface. The nozzle moves in line direction and the printing form cylinder is oriented perpendicular to this movement. A central control unit receives the digital image information from an information media and transfers the control signals through a transfer unit and control unit to the nozzle and the printing form cylinder.

Furthermore, the XEROX™ copy process is generally known. In this process a latent image is generated on a semi-conductor drum, transferred with a powdery toner to a paper sheet and the latent image is raised. However, this process cannot be used in a printing machine.

SUMMARY DESCRIPTION OF THE INVENTION

An object of the present invention is to establish a process to generate an erasable print form on the printing form cylinder of a printing press with low expenditure and high life expectancy.

The present invention accomplishes this with a printing form cylinder having a magnetizeable surface, which can carry a magnetized image and be coated with a toner. The toner adheres to the printing form cylinder. Printing may be completed with the printing form created in this manner. After printing, the toner will be erased from the printing form cylinder with a laser.

BRIEF DESCRIPTION OF THE DRAWINGS

The invention is described below in greater detail by an exemplary embodiment of the present invention, by reference being had to the drawing(s), wherein.

DETAILED DESCRIPTION OF THE INVENTION

Figure 1:
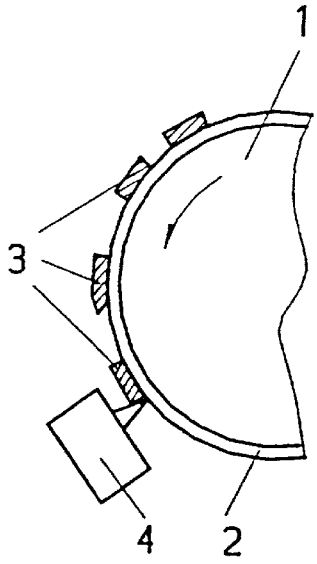
FIG. 1 is a printing form cylinder with an erasing unit.

FIG. 1 shows the printing form cylinder in a printing press. The printing form cylinder 1 has a magnetizeable surface 2 with suitable hydrophilic characteristics. The magnetizeable semi-conductor surface 2 has image carrying locations 3 from the proceeding printing job. These image carrying locations 3 are hydrophobic.

Figure 4:
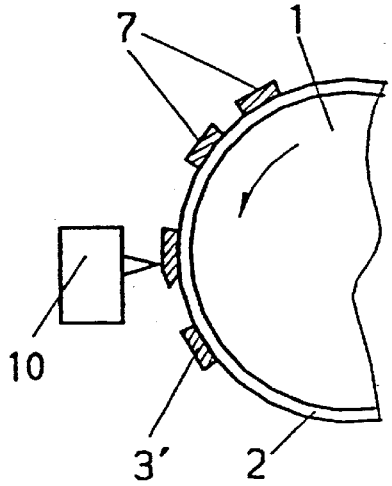
FIG. 4 is a printing form cylinder with a compacting unit.

The image carrying locations 3 of the proceeding printing job must be removed before new image carrying locations 3', shown in FIG. 4, are applied to the printing cylinder 1. The image carrying locations are removed by an erasing unit 4 allocated to the printing form cylinder 1. The erasing unit 4 operates with a laser and traverses or reaches over the entire width of the printing form cylinder 1.

Figure 2:
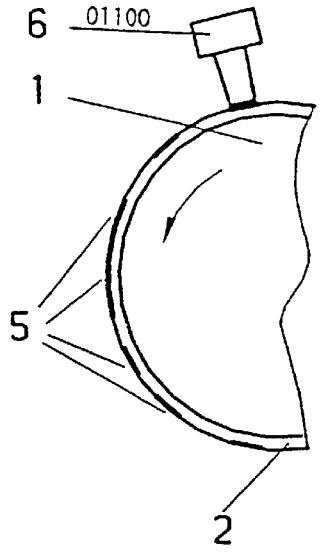
FIG. 2 is a printing form cylinder with a magnetizing unit.

FIG. 2 shows the process step of magnetizing the new image carrying locations 3', shown in FIG. 4, on the magnetizeable surface 2. The new image carrying locations 3' are magnetized for a new printing job with a magnetizing unit 6. The magnetizing makes the magnetized locations 5 receptive for the later applied toner 7, shown in FIG. 3. The magnetizing unit 6 is connected with a memory unit (not shown) for the digital matrix of the image carrying locations.

Similar to the erasing unit 4, the magnetizing unit 6 traverses or reaches over the entire width of the printing form cylinder 1.

Figure 3:
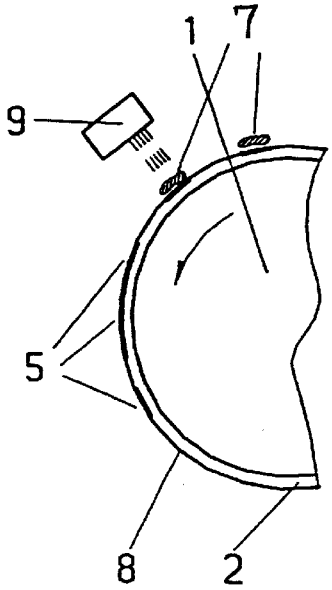
FIG. 3 is a printing form cylinder with a device for applying a toner.

In the next process step shown in FIG. 3, the toner 7 is applied to the magnetizeable surface 2 of the printing form cylinder. The toner 7 is preferably powdery but can also be pasty or liquid. The pasty or liquid toner can be hardened. The toner 7 adheres to the magnetized locations 5 without adhering to the non-magnetized locations 8, which thus stay free of toner. The toner 7 is applied with a device 9 for applying the toner. Similar to the magnetizing unit 6,. this device 9 traverses or reaches over the entire width of the printing form cylinder 1.

FIG. 4 shows the last process step. A compacting unit 10 compacts the toner particles adhering to the magnetized locations 5, shown in FIG. 2, of the magnetizeable surface 2. The compacted toner particles are now identical with the image carrying locations 3'. The printing form is ready for printing after this process step.

I claim:

1. A process for generating and removing a printing image carrying printing form on a printing form cylinder in a printing machine, comprising the steps of:

providing a printing form cylinder having a magnetizeable surface;

magnetizing a printing image onto the printing form cylinder to form magnetized locations embodying the printing image;

adhering toner to the magnetized locations to generate a printing image carrying printing form;

removing the toner from the printing form cylinder with a laser after printing; and wherein the step of adhering the toner includes compacting the toner into the magnetized locations.

2. A process for generating and removing a printing image carrying printing form on a printing form cylinder in a printing machine, comprising the steps of:

providing a printing form cylinder having a magnetizeable surface;

magnetizing a printing image onto the printing form cylinder to form magnetized locations embodying the printing image;

adhering toner to the magnetized locations to generate a printing image carrying printing form;

hardening the toner on the printing form cylinder; and removing the toner from the printing form cylinder with a laser after printing.

* * * * *